US006892894B2

(12) United States Patent
Aiken

(10) Patent No.: US 6,892,894 B2
(45) Date of Patent: May 17, 2005

(54) CAP RACK

(76) Inventor: Scott M. Aiken, 22451 Woodbranch Rd., Georgetown, DE (US) 19947

( * ) Notice: Subject to any disclaimer, the term of this patent is extended or adjusted under 35 U.S.C. 154(b) by 0 days.

(21) Appl. No.: 10/457,858

(22) Filed: Jun. 10, 2003

(65) Prior Publication Data

US 2004/0251221 A1 Dec. 16, 2004

(51) Int. Cl.[7] ..... A47F 7/06
(52) U.S. Cl. ..... 211/30; 211/86.01
(58) Field of Search ..... 211/30, 32, 33, 211/85.18, 85.7, 86.01, 87.01; D6/315; 206/8, 9; 223/1, 24, 25, 84, 85

(56) References Cited

U.S. PATENT DOCUMENTS

| | | | | | |
|---|---|---|---|---|---|
| 700,907 | A | * | 5/1902 | Edwards | 211/30 |
| 5,188,325 | A | * | 2/1993 | Hilty et al. | 248/224.8 |
| 5,240,123 | A | | 8/1993 | Hawk | |
| 5,295,588 | A | | 3/1994 | Neirinckx | |
| 5,411,144 | A | | 5/1995 | Deupree | |
| 5,480,073 | A | | 1/1996 | LaManna | |
| 5,685,465 | A | * | 11/1997 | Berardis | 223/84 |
| 5,758,779 | A | | 6/1998 | Atkins | |
| 5,762,206 | A | | 6/1998 | Leichter | |
| 5,921,403 | A | * | 7/1999 | Coffaro | 211/32 |
| 6,112,909 | A | | 9/2000 | Moseley | |
| 6,223,910 | B1 | * | 5/2001 | Levin et al. | 211/30 |
| 6,311,879 | B1 | | 11/2001 | Rigler et al. | |
| 6,422,401 | B1 | | 7/2002 | Roten | |

* cited by examiner

*Primary Examiner*—Jennifer E. Novosad
(74) *Attorney, Agent, or Firm*—Janet M. Kerr

(57) ABSTRACT

A cap rack is designed for storing and/or displaying baseball style caps in either a horizontal or vertical orientation on a vertical surface or a horizontal surface. The cap rack is designed to have a channel which extends through the length of the base, a channel retainer for attachment of a cap support unit to the base, a cap support unit comprising a hemispherically-shaped cap support section continuous with a rod section, and optionally, a pedestal unit for mounting the cap rack base in either a vertical or horizontal orientation on a horizontal surface. A plurality of cap racks can be interconnected in a vertical and/or horizontal orientation using a 4-way connector, a 90 degree connector, or a 2-way connector.

15 Claims, 10 Drawing Sheets

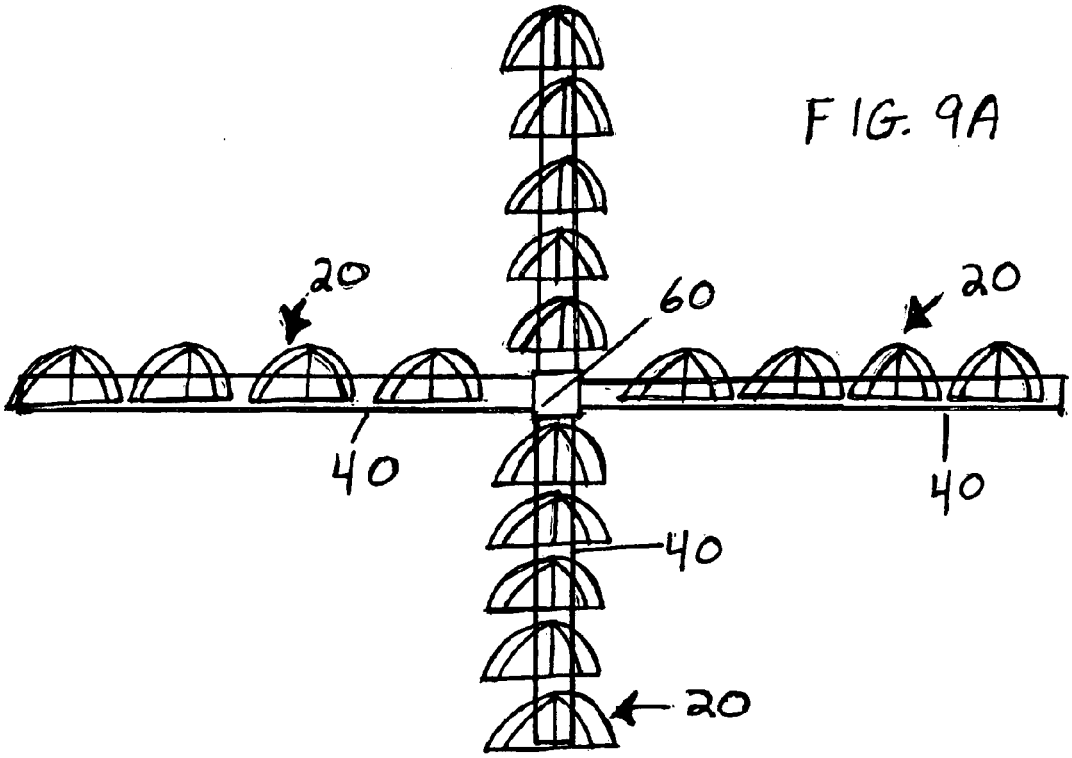
FIG. 9A
FIG. 9B
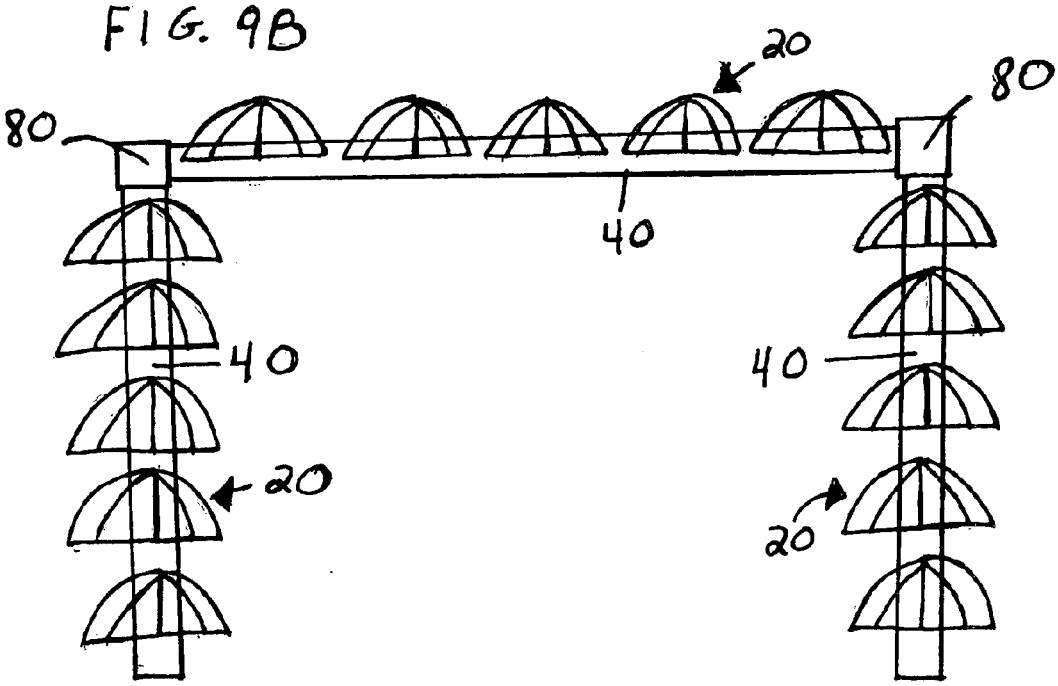

CAP RACK

FIELD OF THE INVENTION

The present invention relates to an expandable cap rack designed to display and store caps, particularly, baseball style caps. The cap rack can be attached to a vertical surface, such as a door or wall, or placed on a horizontal surface, such as a desktop or shelf.

BACKGROUND OF THE INVENTION

Collecting and displaying baseball style caps, i.e., soft-head, hard brim caps, is a popular hobby. Baseball style caps, worn during sporting and leisure activities, display information including names, logos, and other such indicia. The baseball style caps are constructed to comprise a soft-head component having a button at its crown and an adjustable strap along its back, and a hard brim component. Such construction of the baseball style caps allows for a variety of cap rack designs for storage and/or display of the caps. In general, baseball style caps can be placed on the racks using sections of the soft-head component of the cap or using the hard brim component of the cap. With regard to using the hard brim component, U.S. Pat. No. 5,480,073 discloses a cap holder apparatus in which the hard brim is clamped to the rack. To generate or maintain curvature of the hard brim component, U.S. Pat. Nos. 5,758,779, 6,311,879 B1, and 6,422,401 B1 disclose cap holders with apertures (U.S. Pat. No. 5,758,779), slots (U.S. Pat. No. 6,311,879 B1), or sleeves (U.S. Pat. No. 6,422,401 B1); the hard brim is rolled and inserted into the aperture, slot, or sleeve. With regard to using the soft-head component of the cap for placement of a baseball style cap on a cap rack, U.S. Pat. No. 5,240,123 discloses a baseball style cap holder wherein the cap is attached to the rack by means of the crown button. U.S. Pat. No. 5,411,144 discloses placement of a baseball style cap on a rack by means of a slot, wherein the soft-head component of the baseball style cap is folded such that the rear portion is reversed and retained within the front portion forming a planar fold line; this planar fold line is received within the slot in the rack. U.S. Pat. No. 5,762,206 discloses a rack comprising a plurality of hooks, wherein placement of the baseball style cap is by means of hanging the adjustable strap of the soft-head component of the cap over a hook. U.S. Pat. No. 5,295,588 discloses an expandable display type rack with cap body supporting pairs of vertical rods and horizontal rods, which are perpendicular to the vertical rods. The cap is displayed by hanging the soft-head component over a rod. U.S. Pat. No. 6,112,909 discloses a rack comprising a base, a cap support having a hemispheric shape to maintain the shape of the soft-head component of the cap and which is sized to securely hold and display the cap, and a base/cap support attachment rod. An additional feature of this rack is the ability to attach the base/cap support attachment rod to the base in either a vertical or horizontal orientation. This feature provides flexibility in mounting the rack on a surface, such as a door or wall, either vertically or horizontally.

The above-mentioned cap racks, and cap racks in general, are designed to have a plurality of cap supports fixed in permanent positions at predetermined intervals along the length of a rack base. In addition, the caps racks are typically designed for attachment to a vertical surface, such as a wall or door, and accommodation of additional caps for storage and/or display is typically limited to linear expansion of cap racks. These particular features do not allow for flexibility in positioning of the cap along the length of the rack base, for display of a cap rack on a horizontal surface such as a desk, shelf, table, or the like, or for expansion of a cap rack vertically and/or horizontally.

SUMMARY OF THE INVENTION

To overcome the aforementioned limitations, the present invention cap rack is designed for attachment to a flat vertical surface, such as a door or wall, in a horizontal and/or vertical orientation. In addition, by means of a pedestal unit, the cap rack of the present invention is designed for placement on a horizontal surface, such as a shelf or desktop, in either a horizontal or vertical orientation. Furthermore, the cap rack is expandable horizontally and/or vertically, and the cap support units can be moved along the length of and secured to the base of the rack at a desired position. The cap rack of the present invention comprises the following basic components:

a) a base having an upper surface, said upper surface having a slot for receiving the rod section of the cap support unit, a left side surface, a right side surface, and a lower surface, the surfaces configured such that a channel extends through the length of the base, a channel retainer for attachment of a cap support unit to the base, b) a cap support unit comprising a hemispherically-shaped cap support section continuous with a rod section, and optionally, c) a pedestal unit comprising a pedestal post and a pedestal base for mounting the cap in a horizontal and/or vertical orientation on a horizontal surface.

It is a first object of the invention to provide a cap rack for storing and displaying a baseball style cap in a manner that retains the hemispherical shape of the soft-head component of the cap. It is a second object of the invention to provide a cap rack in which a plurality of baseball style caps can be stored and displayed at desired positions along the length of the base of the cap rack. It is a third object of the invention to provide a cap rack that can be mounted to a vertical surface in a horizontal and/or vertical orientation. It is a fourth object of the invention to provide a cap rack mounted to a pedestal unit such that the cap rack can be positioned on a horizontal surface in either a horizontal or vertical orientation.

BRIEF DESCRIPTION OF THE DRAWINGS

FIG. 8A is a perspective view of a 4-way connector interconnecting cap racks horizontally and vertically. FIG. 8B is a perspective view of a 90 degree connector for interconnecting cap racks horizontally and vertically. FIG. 8C is a perspective view of a 2-way connector for interconnecting cap racks either horizontally or vertically.

FIGS. 9A–B show front elevational views of interconnected cap racks. FIG. 9A is a front elevational view of four cap racks interconnected by means of a 4-way connector. Each of the horizontally oriented cap racks has four cap support units secured to the base, and each of the vertically oriented cap racks has five cap support units secured to the base. FIG. 9B is a front elevational view of three cap racks interconnected by means of 90 degree connectors. Each of the three hat racks has five cap support units secured to the base.

FIG. 10A is a perspective view of a vertical pedestal post retainer. FIG. 10B is a front elevational view of a cap rack mounted to a pedestal unit.

DETAILED DESCRIPTION OF THE INVENTION

The cap rack of the present invention is designed to allow a plurality of baseball style caps to be store and/or displayed such that the hemispherical shape of the soft-head component is maintained. In addition, the present invention is designed to provide flexibility in positioning the caps along the length of the cap rack base, flexibility in selecting a mounting surface for the cap rack, such as a vertical surface or a horizontal surface, and flexibility in spatially orienting the cap rack horizontally and/or vertically on either a vertical or horizontal surface. All components of the cap rack can be manufactured using metal, plastic, or wood materials.

Figure 1:
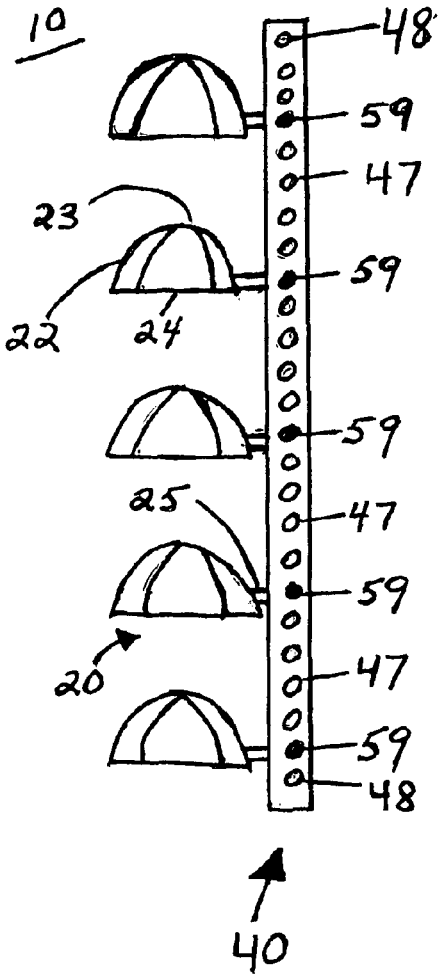
FIG. 1 is a side elevational view of the cap rack showing the base in a vertical orientation, and five cap support units attached to the base with retainer pins.
Figure 2:
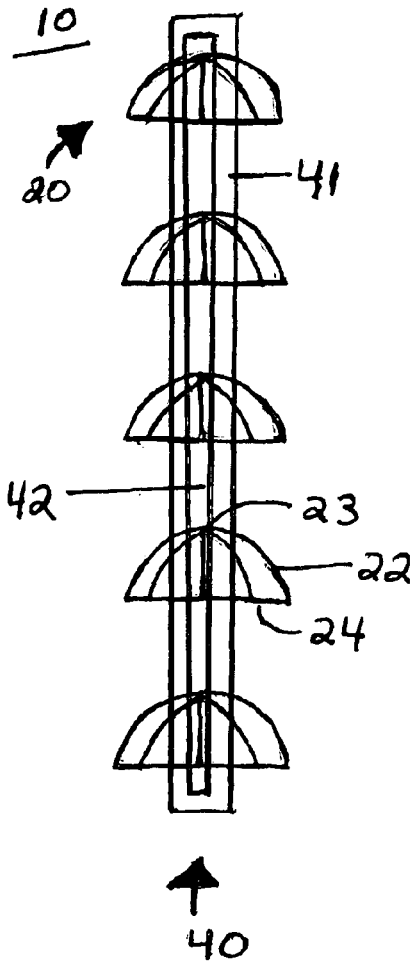
FIG. 2 is a front elevational view of the cap rack showing the base in a vertical orientation, the slot in the upper surface of the base for receiving cap support units, and five cap support units attached to the base.

The cap rack is comprised of a base, a cap support unit, means for securing the cap support unit to the base, and optionally, a pedestal unit for positioning the cap rack on a horizontal surface. Referring to the drawings for the purpose of illustrating preferred embodiments of the invention and not limiting same, FIGS. 1 and 2 show side and front views, respectively, of the cap rack 10 positioned in a vertical orientation, and comprising a cap support unit 20 and a base 40.

Figure 3:
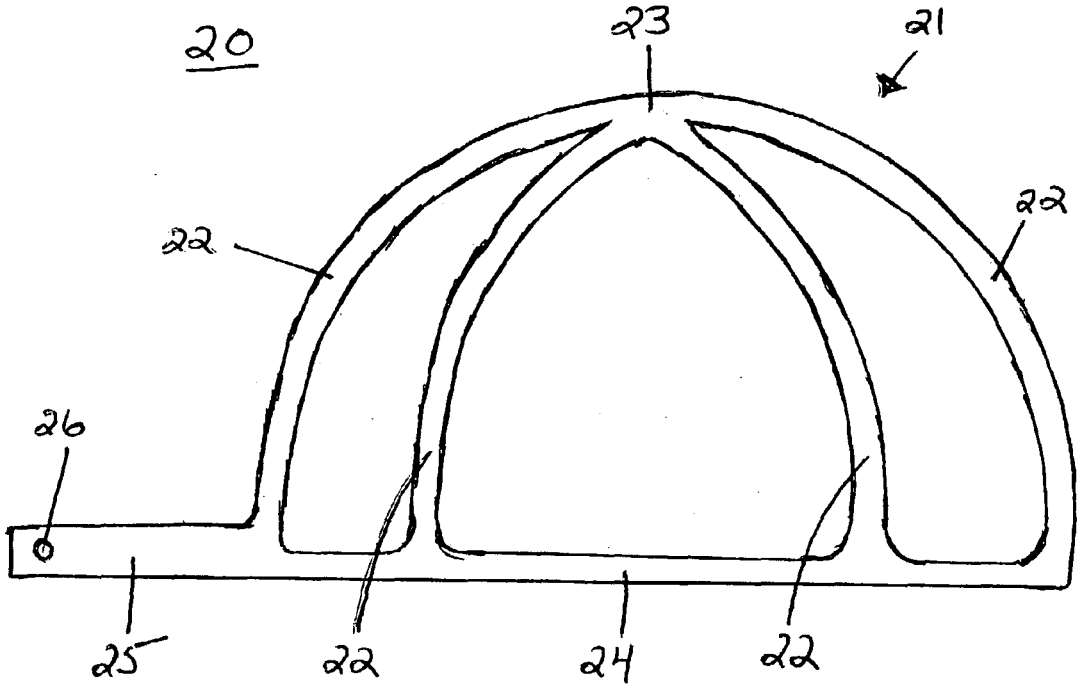
FIG. 3 is a side view of the cap support unit showing a hemispherical cap support section continuous with a rod section. The base end of the rod section has a horizontal retainer pin hole spanning the width of the rod.
Figure 4:
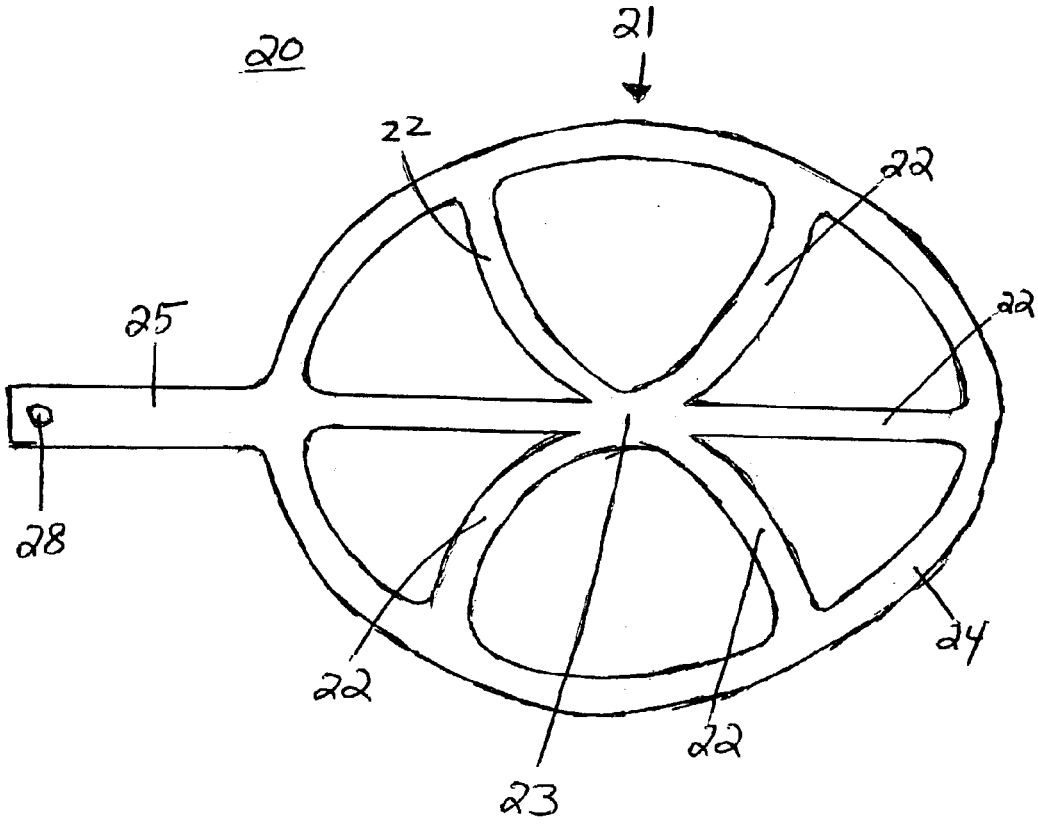
FIG. 4 is a top view of the cap support unit showing a hemispherical cap support section continuous with a rod section. The base end of the rod section has a vertical retainer pin hole spanning the width of the rod.

FIGS. 3 and 4 illustrate side and top views, respectively, of the cap support unit 20. Cap support unit 20 comprises cap support section 21 continuous with rod section 25. Cap support section 21 is dimensioned to allow the soft-head portion of a baseball style cap to fit over the cap support section 21, and is comprised of a plurality of substantially hemispherically-shaped ribs 22, wherein the upper ends of hemispherically-shaped ribs 22 are connected at the apex 23, and the lower ends of hemispherically-shaped ribs 22 are connected to a circumferential rib 24. FIG. 3 shows a horizontal rod retainer pin hole 26 in rod section 25 which is used in securing cap support unit 20 to base 40 when cap rack 10 is oriented vertically, as illustrated in FIGS. 1 and 2. For horizontal orientation of cap rack 10, vertical rod retainer pin hole 28, shown in FIG. 4, is used in securing cap support unit 20 to base 40.

Figure 5:
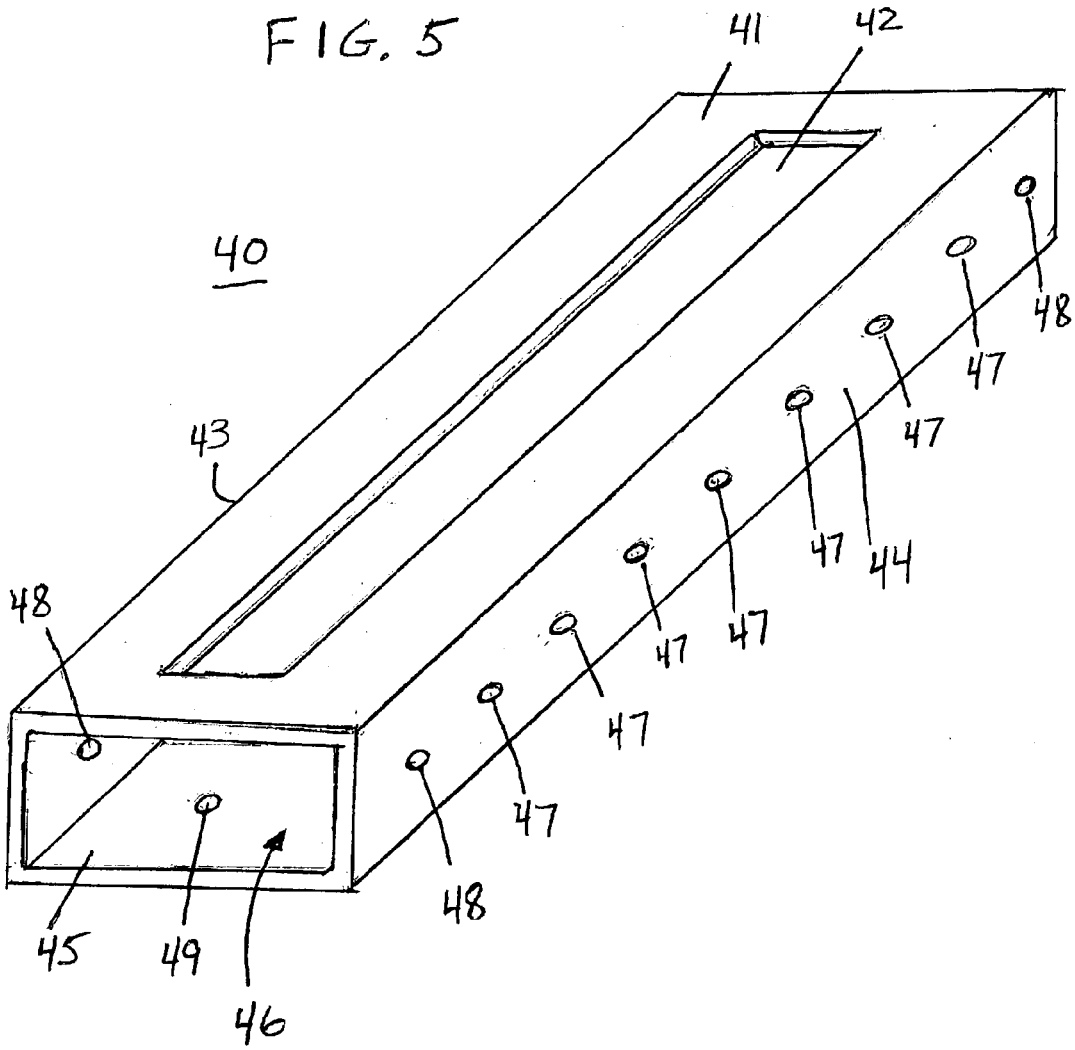
FIG. 5 is a perspective view of the base showing a channel spanning the length of the base, retainer pin holes positioned along the length of the side surfaces of the base, a slot in the upper surface for receiving the rod section of the cap support unit, and a mounting screw hole on the lower surface of the base.

A detailed illustration of base 40 is shown in FIG. 5. Base 40 is rectangular in shape, the length of which accommodates up to five baseball style caps. Base 40 comprises an upper surface 41, a left side surface 43, a right side surface 44, and a lower surface 45. The surfaces of base 40 are configured such that channel 46 is formed along the entire length of base 40. Upper surface 41 contains slot 42, the dimensions of which allow for insertion of rod section 25 of cap support unit 20 into channel 46. A plurality of side surface retainer pin holes 47 are spaced equidistant along the length of side surfaces 43, 44. In addition, a connector retainer pin hole 48 is located at each end of side surfaces 43, 44. Located along lower surface 45 are at least two screw bores 49 for mounting cap rack 10 on a vertical surface in either a horizontal or vertical orientation.

Figure 6:
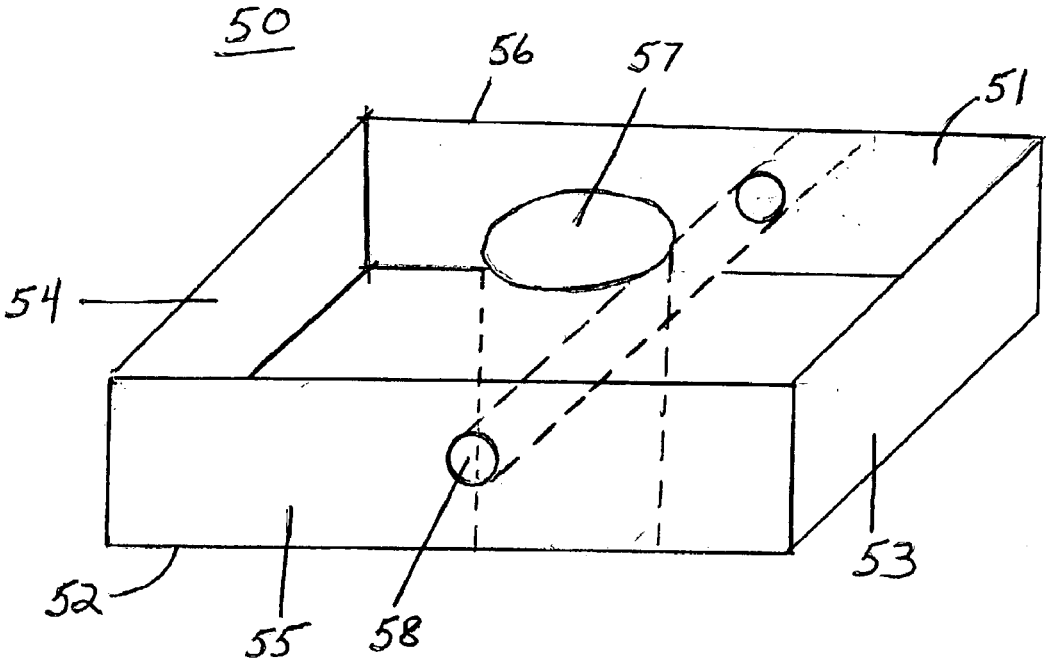
FIG. 6 is a perspective view of the channel retainer showing a channel retainer bore hole for receiving the rod section of the cap support unit, and a channel retainer pin hole for receiving the retainer pin.

Securement of cap support unit 20 to base 40 is by means of a channel retainer 50. FIG. 6 illustrates channel retainer 50, which is rectangular in shape, and dimensioned to frictionally slide along channel 46 of base 40. Channel retainer 50 has an upper surface 51, a lower surface 52, a right side surface 53, a left side surface 54, a front surface 55, and a rear surface 56. Channel retainer 50 has a substantially centered vertical channel retainer bore 57 extending from upper surface 51 through lower surface 52 and is dimensioned for frictional insertion of rod section 25 of cap support unit 20. In addition, channel retainer 50 has a substantially centered channel retainer pin hole 58 extending from front surface 55 through rear surface 56. Channel retainer 50 is inserted into and guided along channel 46 of base 40 until channel retainer pin hole 58 is aligned with side surface retainer pin holes 47 at the desired position along the length of base 40.

Figure 7:
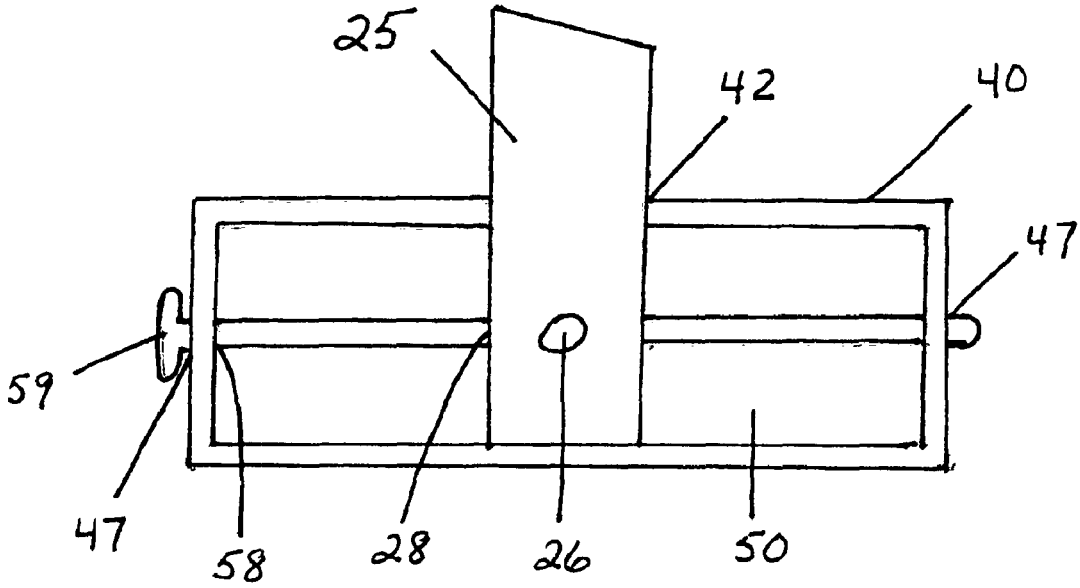
FIG. 7 is a sectional view of the base in which the rod section of the cap support unit is inserted into the channel retainer bore hole; the cap support unit and channel retainer are secured to the base by means of a retainer pin.

FIG. 7 shows a portion of rod section 25 of cap support unit 20 inserted through slot 42, and through vertical channel retainer bore 57 of channel retainer 50. To secure cap support unit 20 to base 40 when cap rack 10 is horizontally oriented, channel retainer 50 is guided along channel 46 to the desired position along base 40 such that channel retainer pin hole 58 is aligned with side surface retainer pin holes 47 on left and right side surfaces 43, 44. Rod section 25 of cap support unit 20 is inserted into the base 40 through slot 42, and inserted into vertical channel retainer bore 57 of channel retainer 50. Horizontal rod retainer pin hole 26 of rod section 25 is aligned with channel retainer pin hole 58 and side surface retainer pin holes 47 located on left and right side surfaces 43, 44. To secure cap support unit 20 and channel retainer 50 to base 40, retainer pin 59 is inserted through side surface retainer pin hole 47 on either left side surface 43 or right side surface 44, through channel retainer pin hole 58, through horizontal rod retainer pin hole 26, and through side surface retainer pin hole 47 on the opposite side surface of base 40. To appropriately position cap support unit 20 when cap rack 10 is vertically oriented, retainer pin 59 is removed from cap rack 10, and cap support unit 20 is turned 90 degrees such that vertical rod retainer pin hole 28 is aligned with side surface retainer pin holes 47 on either left side surface 43 or right side surface 44, and channel retainer pin hole 58. To secure cap support unit 20 and channel retainer 50 to base 40, retainer pin 59 is inserted through side surface retainer pin hole 47 on either left side surface 43 or right side surface 44, through channel retainer pin hole 58, through vertical rod retainer pin hole 28, and through side surface retainer pin hole 47 on the opposite side surface of base 40.

Figure 8A:
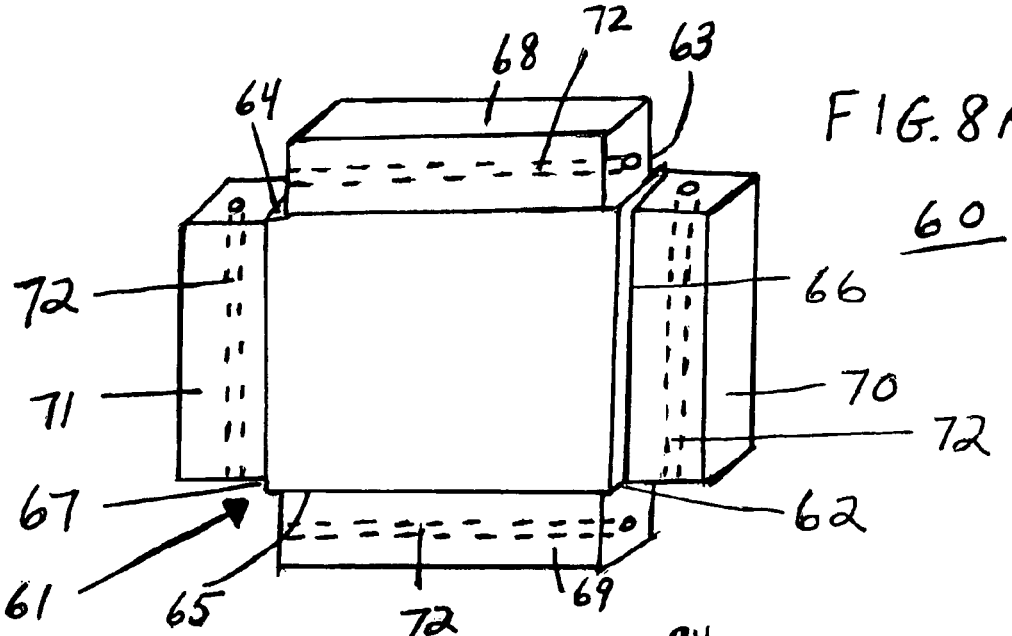
FIGS. 8A–C show perspective views of connectors used in interconnecting cap racks horizontally and/or vertically.
Figure 8B:
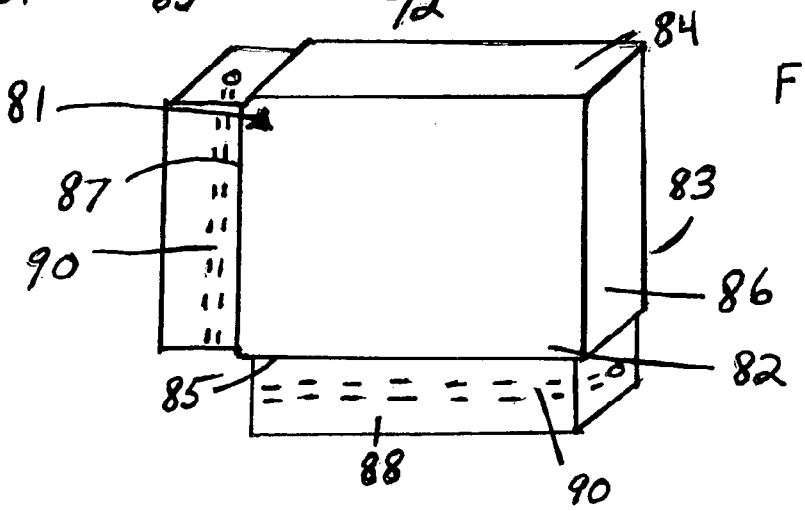
Figure 8C:
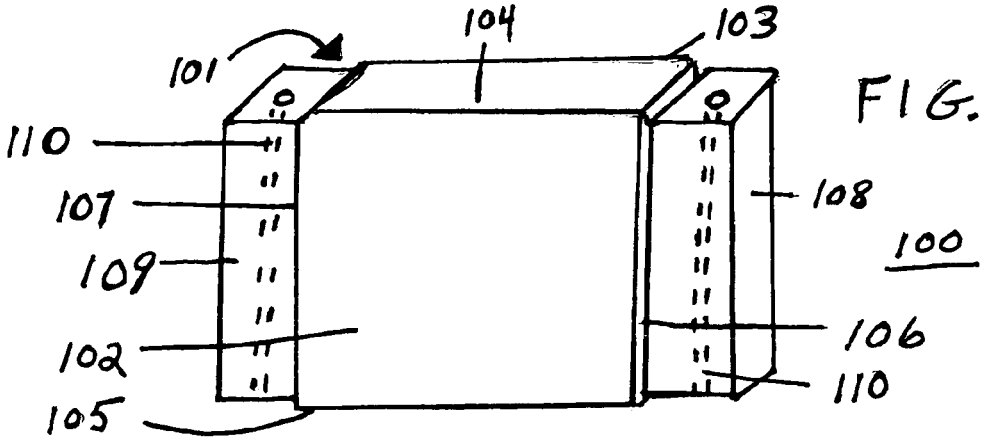

Interconnecting a plurality of cap racks 10 by means of a 4-way connector 60, a 90 degree connector 80, or a 2-way connector 100, illustrated in FIGS. 8A–C, results in expansion of the cap rack 10 horizontally and/or vertically as illustrated in FIGS. 9A–B. The 4-way connector 60, as shown in FIG. 8A, comprises a cap body portion 61 having a front surface 62, a back surface 63, an upper surface 64, a lower surface 65, a right side surface 66, and a left side surface 67. Extending from upper surface 64, lower surface 65, right side surface 66, and left side surface 67 are upper insert projection 68, lower insert projection 69, right side insert projection 70, and left side insert projection 71, respectively. Cap body portion 61 is rectangular in shape, having the same height and width dimensions as base 40, and having a length sufficient to allow placement of baseball style caps on cap support units 20 positioned at the ends of horizontally and vertically interconnected bases 40 as shown in FIG. 9A. Insert projections 68, 69, 70, 71 are rectangular in shape and dimensioned to frictionally insert into channel 46 of base 40. Spanning the length of each insert projection 68, 69, 70, 71 is a connector pin hole 72, the location of which is aligned with connector retaining pin holes 48 on the left side surface 43 and the right side surface 44 of base 40 when insert projections 68, 69, 70, 71 are inserted into the channels 50 of four bases 40.

Interconnecting two cap racks 10 at a 90 degree angle from each other is by means of a 90 degree connector. As shown in FIG. 8B, 90 degree connector 80 comprises a cap body portion 81 having a front surface 82, a back surface 83, an upper surface 84, a lower surface 85, a right side surface 86, and a left side surface 87. Insert projection 88 extends from lower surface 85, and insert projection 89 extends from either right side surface 86 or left side surface 87 (as shown in FIG. 8B) such that insert projections 88 and 89 are perpendicular to each other. Cap body portion 81 is rectangular in shape, having the same height and width dimensions as base 40, and having a length sufficient to allow placement of baseball style caps on cap support units 20 positioned at the ends of horizontally and vertically interconnected bases 40 as shown in FIG. 9B. Insert projections 88, 89 are rectangular in shape and dimensioned to frictionally insert into channel 46 of base 40. Spanning the length of each insert projection 88, 89 is a connector pin hole 90, the location of which is aligned with connector retaining pin holes 48 on the left side surface 43 and the right side surface 44 of base 40 when insert projections 88, 89 are inserted into the channels 46 of four bases 40.

For linear extension of cap racks 10 in either a horizontal or vertical orientation, a 2-way connector, as shown in FIG. 8C, is utilized. The 2-way connector 100 comprises a cap body portion 101 having a front surface 102, a back surface 103, an upper surface 104, a lower surface 105, a right side surface 106, and a left side surface 107. Insert projection 108 extends from right side surface 106, and insert projection 109 extends from left side surface 107 such that insert projections 108 and 109 are linear to each other. Cap body portion 101 is rectangular in shape, having the same height and width dimensions as base 40, and having a length sufficient to allow placement of baseball style caps on cap support units 20 positioned at the ends of either horizontally or vertically interconnected bases 40. Insert projections 108, 109 are rectangular in shape and dimensioned to frictionally insert into channel 46 of base 40. Spanning the length of each insert projection 108, 109 is a connector pin hole 110, the location of which is aligned with connector retaining pin holes 48 on the left side surface 43 and the right side surface 44 of base 40 when insert projections 108, 109 are inserted into the channels 46 of two bases 40.

Cap rack 10 can be vertically positioned on a horizontal surface, such as a desktop, shelf, or the like, either in a vertical or horizontal orientation with pedestal units.

Figure 10A:
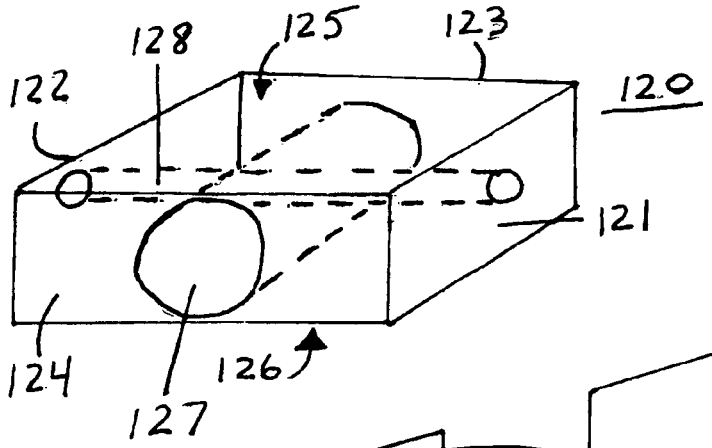
FIGS. 10A–B show views of a vertical pedestal post retainer and a cap rack vertically mounted on a pedestal unit by means of the vertical pedestal post retainer.
Figure 10B:
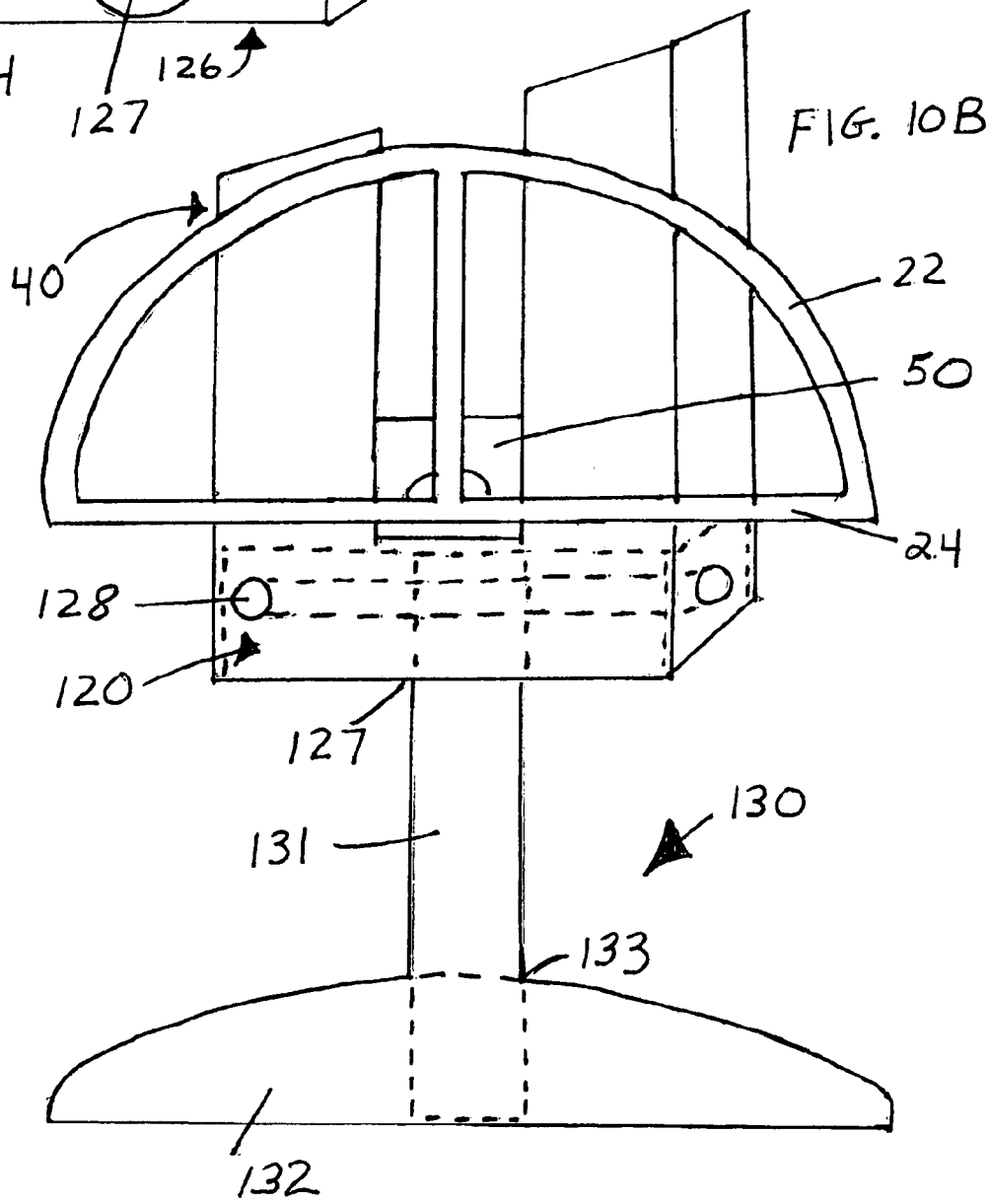

By means of a vertical pedestal post retainer 120, vertically oriented cap rack 10 is secured to pedestal unit 130 as illustrated in FIGS. 10A–B. Vertical pedestal post retainer 120, shown in FIG. 10A, comprises an upper surface 121, a lower surface 122, a right side surface 123, a left side surface 124, a front surface 125, and a rear surface 126, and is dimensioned to frictionally fit into channel 46 of base 40. Substantially centered and extending from right side surface 123 through left side surface 124 is a pedestal post bore 127. Substantially centered and extending from upper surface 121 through lower surface 122 is retainer pin hole 128. As illustrated in FIG. 10B, to secure cap rack 10 to pedestal post unit 130, vertical pedestal post retainer 120 is frictionally inserted into channel 46 such that retainer pin hole 128 is juxtaposed to and in alignment with connector retainer pin holes 48 located on left and right side surfaces 43, 44 of base 40. Retainer pin 59 is inserted through either left side surface 43 or right side surface 44, through retainer pin hole 128 of vertical pedestal post retainer 120 and through the opposite side surface of base 40.

Pedestal unit 130 comprises a pedestal post 131 and a pedestal base 132. Pedestal post 131 is cylindrical in shape, the diameter of which is sized to frictionally insert into pedestal post bore 127 of vertical pedestal post retainer 120. Pedestal base 132 can be hemispheric (as shown in FIG. 10B) or rectangular in shape, the center of which has a bore 133 dimensioned for frictional insertion of pedestal post 131.

Figure 11:
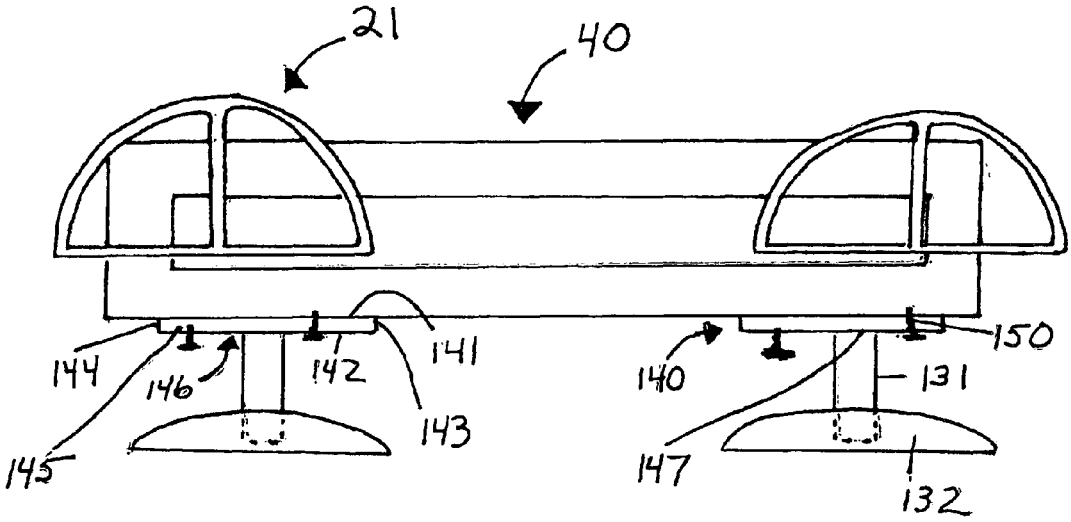
FIG. 11 is a partial view of a horizontally mounted cap rack on two pedestals units.

Placement of the cap rack on a horizontal surface and in a horizontal orientation is illustrated in FIG. 11. Horizontal pedestal post retainers 140, which are fixed to left side surface 43 or right side surface 44 of base 40 by insertion of mounting screws 150 into pedestal retainer screw bores 151, are rectangular in shape, having a top post retainer surface 141, a bottom post retainer surface 142, a right side post retainer surface 143, a left side post retainer surface 144, a front post retainer surface 145, and a rear post retainer surface 146. A pedestal post retainer cavity 147 extends from the center of the top post retainer surface 141 through the bottom post retainer surface 142 and is dimensioned for frictional insertion of pedestal post 131. Two pedestal retainer screw bores 151 extend from top post retainer surface 141 through bottom post retainer surface 142, and are used in the attachment of horizontal pedestal post retainers 140 to base 40. For horizontal placement of rack 10 on a horizontal surface, at each end of cap rack 10, one end of pedestal post 131 is frictionally inserted into horizontal pedestal post retainer 140 and the opposite end of pedestal post 131 is frictionally inserted into bore 133 of pedestal base 132.

As discussed above, the cap rack is designed to accommodate up to five cap support units. To increase the number of baseball style caps stored and/or displayed, the cap racks are interconnected by means of 4-way connectors, 2-way connectors, or 90 degree connectors. Expansion of the cap rack by means of connectors provides flexibility in the design and configuration of cap racks mounted on either vertical or horizontal surfaces.

While the preferred embodiments of the invention has been described and illustrated in detail, it will be understood that the preferred embodiments are provided by way of example only. Variations, changes, and modifications may be made in the invention without departing from the spirit and scope of the invention.

What is claimed is:

1. A cap rack comprising a) a base, said base having i) an upper surface, said upper surface having a slot for receiving a rod section of a cap support unit, ii) a lower surface, said lower surface having at least two screw bores for attachment of the cap rack to a vertical surface, iii) a right side surface, said right side surface having a plurality of retainer pin holes along the length of said right side surface and further having a connector pin hole at each end of said right side surface, and iv) a left side surface, said left side surface having a plurality of retainer pin holes along the length of said left side surface and further having a connector pin hole at each end of said left side surface, said upper surface, lower surface, right side surface, and left side surface configured to form a channel for receiving a channel retainer;

b) a channel retainer, said channel retainer having i) an upper surface, a lower surface, a right side surface, a left side surface, a front surface, and a rear surface, ii) a vertical channel retainer bore extending from said upper surface through said lower surface, and iii) a channel retainer pin hole extending from said front surface through said rear surface;

c) a cap support unit, said cap support unit having a hemispherically-shaped cap support section and a rod section, said rod section having a horizontal rod retainer pin hole and a vertical rod retainer pin hole; and d) a retainer pin.

2. The cap rack of claim 1, comprising a means for vertical positioning of said cap rack on a horizontal surface, said means for vertical positioning comprising i) a vertical pedestal post retainer having an upper surface, a lower surface, a right side surface, a left side surface, a front surface, and a rear surface, a pedestal post bore extending from said right side surface through said left side surface, and a retainer pin hole, said retainer pin hole extending from said upper surface through said lower surface; and ii) a pedestal post unit comprising a pedestal post and a pedestal base.

3. The cap rack of claim 1, further comprising a means for horizontal positioning of said cap rack on a horizontal surface, said means for horizontal positioning comprising i) a horizontal pedestal post retainer having a top post retainer surface, a bottom post retainer surface, a right side post retainer surface, a left side post retainer surface, a front post retainer surface, a rear post retainer surface, a post retainer cavity, said post retainer cavity extending from said top post retainer surface through said bottom post retainer surface, and two screw bores extending from said top post retainer surface through said bottom post retainer surface; and ii) a pedestal post unit comprising a pedestal post and a pedestal base.

4. An expandable cap rack, said expandable cap rack comprising a plurality of individual cap racks, said individual cap racks each comprising a) a base, said base having i) an upper surface, said upper surface having a slot for receiving a rod section of a cap support unit, ii) a lower surface, said lower surface having at least two screw bores for attachment of the cap rack to a vertical surface, iii) a right side surface, said right side surface having a plurality of retainer pin holes along the length of said right side surface and further having a connector pin hole at each end of said right side surface, and iv) a left side surface, said left side surface having a plurality of retainer pin holes along the length of said left side surface and further having a connector pin hole at each end of said left side surface, said upper surface, lower surface, right side surface, and left side surface configured to form a channel for receiving a channel retainer, b) a channel retainer, said channel retainer having i) an upper surface, a lower surface, a right side surface, a left side surface, a front surface, and a rear surface, ii) a vertical channel retainer bore extending from said upper surface through said lower surface, and iii) a channel retainer pin hole extending from said front surface through said rear surface;

c) a cap support unit, said cap support unit having a hemispherically-shaped cap support section and a rod section, said rod section having a horizontal rod retainer pin hole and a vertical rod retainer pin hole;

d) a retainer pin; and e) a means for interconnecting said plurality of individual cap racks in a vertical orientation, a horizontal orientation, or both horizontal and vertical orientations, said means for interconnecting selected from the group consisting of a) a 4-way connector, b) a 90 degree connector, and c) a 2-way connector.

5. The expandable cap rack of claim 4 wherein said means for interconnecting said plurality of individual cap racks is a 4-way connector.

6. The expandable cap rack of claim 4, wherein said means for interconnecting said plurality of individual cap racks is a 90 degree connector.

7. The expandable cap rack of claim 4 wherein said means for interconnecting said plurality of individual cap racks is a 2-way connector.

8. The expandable cap rack of claim 4, further comprising a means for vertical positioning of said expandable cap rack on a horizontal surface, said means for vertical positioning comprising i) a vertical pedestal post retainer having an upper surface, a lower surface, a right side surface, a left side surface, a front surface, and a rear surface, a pedestal post bore extending from said right side surface through said left side surface, and a retainer pin hole, said retainer pin hole extending from said upper surface through said lower surface; and ii) a pedestal post unit comprising a pedestal post and a pedestal base.

9. The expandable cap rack of claim 8 wherein said means for interconnecting said plurality of individual cap racks is a 4-way connector.

10. The expandable cap rack of claim 8 wherein said means for interconnecting said plurality of individual cap racks is a 90 degree connector.

11. The expandable cap rack of claim 8 wherein said means for interconnecting said plurality of individual cap racks is a 2-way connector.

12. The expandable cap rack of claim 4, further comprising a means for horizontal positioning of said expandable cap rack on a horizontal surface, said means for horizontal positioning comprising i) a horizontal pedestal post retainer having a top post retainer surface, a bottom post retainer surface, a right side post retainer surface, a left side post retainer surface, a front post retainer surface, a rear post retainer surface, a post retainer cavity, said post retainer cavity extending from said top post retainer surface through said bottom post retainer surface, and two screw bores extending from said top post retainer surface through said bottom post retainer surface; and ii) a pedestal post unit comprising a pedestal post and a pedestal base.

13. The expandable cap rack of claim 12 wherein said means for interconnecting said plurality of individual cap racks is a 4-way connector.

14. The expandable cap rack of claim 12 wherein said means for interconnecting said plurality of individual cap racks is a 90 degree connector.

15. The expandable cap rack of claim 12 wherein said means for interconnecting said plurality of individual cap racks is a 2-way connector.

* * * * *